US011026468B2

(12) United States Patent
Hall et al.

(10) Patent No.: US 11,026,468 B2
(45) Date of Patent: Jun. 8, 2021

(54) MANDIBLE GUARD

(71) Applicant: Galvion Ltd., Portsmouth, NH (US)

(72) Inventors: Edward R. Hall, Starksboro, VT (US); Pierre-Luc Lussier, Longueuil (CA); Nicolas Desjardins, Pincourt (CA); Stéphane Lebel, St. Redempteur (CA); Dominic Giroux Bernier, St-Gabriel De Brandon (CA)

(73) Assignee: Galvion Ltd., Portsmouth, NH (US)

( * ) Notice: Subject to any disclaimer, the term of this patent is extended or adjusted under 35 U.S.C. 154(b) by 423 days.

(21) Appl. No.: 15/284,504

(22) Filed: Oct. 3, 2016

(65) Prior Publication Data

US 2018/0092426 A1 Apr. 5, 2018

(51) Int. Cl.

| | |
|---|---|
| ***A42B 3/20*** | (2006.01) |
| ***A42B 3/32*** | (2006.01) |
| ***F41H 1/04*** | (2006.01) |

(52) U.S. Cl.

CPC ..... *A42B 3/205* (2013.01); *A42B 3/326* (2013.01); *A42B 3/328* (2013.01); *F41H 1/04* (2013.01)

(58) Field of Classification Search

CPC ..... A42B 3/00; A42B 3/04; A42B 3/0406; A42B 3/18; A42B 3/20; A42B 3/205; A42B 3/326; A42B 3/32

USPC ..... 2/424, 9, 468

See application file for complete search history.

(56) References Cited

U.S. PATENT DOCUMENTS

| | | | | |
|---|---|---|---|---|
| 289,219 | A * | 6/1959 | Monetta | |
| 2,892,195 | A | 6/1959 | Monetta | |
| 4,734,940 | A * | 4/1988 | Galet | A42B 3/288 2/422 |
| 5,003,632 | A | 4/1991 | Claude | |
| 6,047,400 | A * | 4/2000 | Spencer | A42B 3/20 2/424 |
| 7,908,667 | B2 | 3/2011 | Rogers et al. | |
| 10,281,241 | B2 | 5/2019 | Noordzij et al. | |
| 2011/0145964 | A1 * | 6/2011 | Crye | F41H 1/04 2/2.5 |

(Continued)

FOREIGN PATENT DOCUMENTS

| | | |
|---|---|---|
| CH | 670 744 A5 | 7/1989 |
| DE | 1 717 460 U | 2/1956 |

OTHER PUBLICATIONS

[No Author Listed], Moto Visor & Mandible for Sentry Image. NFM Group. Accessed Sep. 30, 2016. Available at: http://www.nfm.no/moto-visor--mandible-for-sentry,p. html 2 pages.

(Continued)

*Primary Examiner* — Sally Haden

(74) *Attorney, Agent, or Firm* — Wolf, Greenfield & Sacks, P.C.

(57) ABSTRACT

A helmet assembly having a helmet, a mandible guard, and an accessory attachment system that is used to selectively attach and secure the mandible guard to the helmet is disclosed. In some embodiments, the mandible guard is arranged to be detached from a first side of the helmet while remaining secured to a second side of the helmet. In such embodiments, the mandible guard may be moved outwardly and away from a wearer as the mandible guard pivots around the accessory attachment system attached to the second side of the helmet.

16 Claims, 10 Drawing Sheets

(56) References Cited

U.S. PATENT DOCUMENTS

| | | | | |
|---|---|---|---|---|
| 2014/0033406 | A1* | 2/2014 | Lebel | A42B 3/04 2/422 |
| 2014/0075654 | A1* | 3/2014 | McGinn | A42B 3/18 2/422 |
| 2014/0143937 | A1* | 5/2014 | Cram | A42B 3/32 2/410 |
| 2014/0259319 | A1* | 9/2014 | Ross | A42B 3/18 2/424 |
| 2015/0135417 | A1* | 5/2015 | Lebel | A42B 3/326 2/424 |
| 2015/0342283 | A1 | 12/2015 | Lebel et al. | |
| 2018/0092425 | A1* | 4/2018 | Hall | F41H 1/04 |

OTHER PUBLICATIONS

[No Author Listed], Moto Visor & Mandible for Sentry. NFM Group. Accessed Sep. 30, 2016. Available at: http://www.nfm.no/moto-visor--mandible-for-sentry,p.html 2 pages.

[No Author Listed], System Capabilities. NFM Group. Accessed Sep. 30, 2016. Available at: http://www.nfm.no/ops-core/system-capabilities.html. 3 pages.

U.S. Appl. No. 29/579,739, filed Oct. 3, 2016, Hall et al.

U.S. Appl. No. 15/284,454, filed Oct. 3, 2016, Desjardins et al.

International Search Report and Written Opinion dated Mar. 5, 2018 for Application No. PCT/IB2017/001382.

* cited by examiner

MANDIBLE GUARD

FIELD

The disclosed embodiments relate generally to mandible guard systems for helmets, and more specifically to systems and methods for moving the mandible guard with respect to the helmet.

DISCUSSION OF THE RELATED ART

A soldier, first responder, or law enforcement officer may wear protective headgear such as a helmet. Such a helmet may mount various accessories to aid and/or protect the helmet wearer for a specific activity or environment. For example, a mandible guard may be mounted to the helmet to provide jaw and face protection.

SUMMARY

According to one embodiment, a helmet assembly includes a helmet, a mandible guard having a mouth covering portion, a first attachment arm arranged to removably secure a first side of the mandible guard to the helmet, the first attachment arm extending from a helmet connection region to a mandible guard connection region, and a second attachment arm arranged to removably secure a second side of the mandible guard to the helmet, the second attachment arm extending from a helmet connection region to a mandible guard connection region. When the mandible guard is secured to the helmet with the first and second attachment arms, the mouth covering portion maintains a protection position in which the mouth covering portion is aligned with a midline of the helmet, and movement of the mandible guard in a direction from a front of the helmet to a back of the helmet is prevented by the helmet assembly. When the second attachment arm is detached from the helmet and the first attachment arm remains secured to the helmet, the mandible guard is movable out of the protection position.

According to another embodiment, a method includes removably securing a first side of a mandible guard to a helmet via a first attachment arm, the first attachment arm extending from a helmet connection region to a mandible guard connection region, and removably securing a second side of the mandible guard to the helmet via a second attachment arm extending from a helmet connection region to a mandible guard connection region, wherein, the mandible guard has a mouth covering portion, and wherein when the mandible guard is secured to the helmet with the first and second attachment arms, the mouth covering portion is aligned with a midline of the helmet, and movement of the mandible guard in a direction from a front of the helmet to a back of the helmet is prevented. The method also includes detaching the second attachment arm from the helmet and moving the mandible guard out of the protection position while the first attachment arm remains secured to the helmet.

According to a further embodiment, a mandible guard assembly includes a mandible guard having a mouth covering portion. A first attachment arm is pivotally attached to the mandible guard and has a first attachment arm mount to removably secure a first side of the mandible guard to a helmet. The assembly also includes a second attachment arm pivotally attached to the mandible guard, the second attachment arm having a second attachment arm mount to removably secure a second side of the mandible guard to a helmet. The first and second attachment arms are pivotable toward each other until each attachment arm reaches a respective stop position at which the first and second attachment arm mounts are oriented for attachment to a helmet, and further pivoting of the first and second attachment arms toward each other is prevented. The first attachment arm is pivotally attached to the mandible guard such that a first pivot axis is oriented at an angle of sixty degrees or less relative to horizontal when the helmet is oriented in an upright position, and the second attachment arm is pivotally attached to the mandible guard such that a second pivot axis is oriented at an angle of sixty degrees or less relative to horizontal when the helmet is oriented in an upright position.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
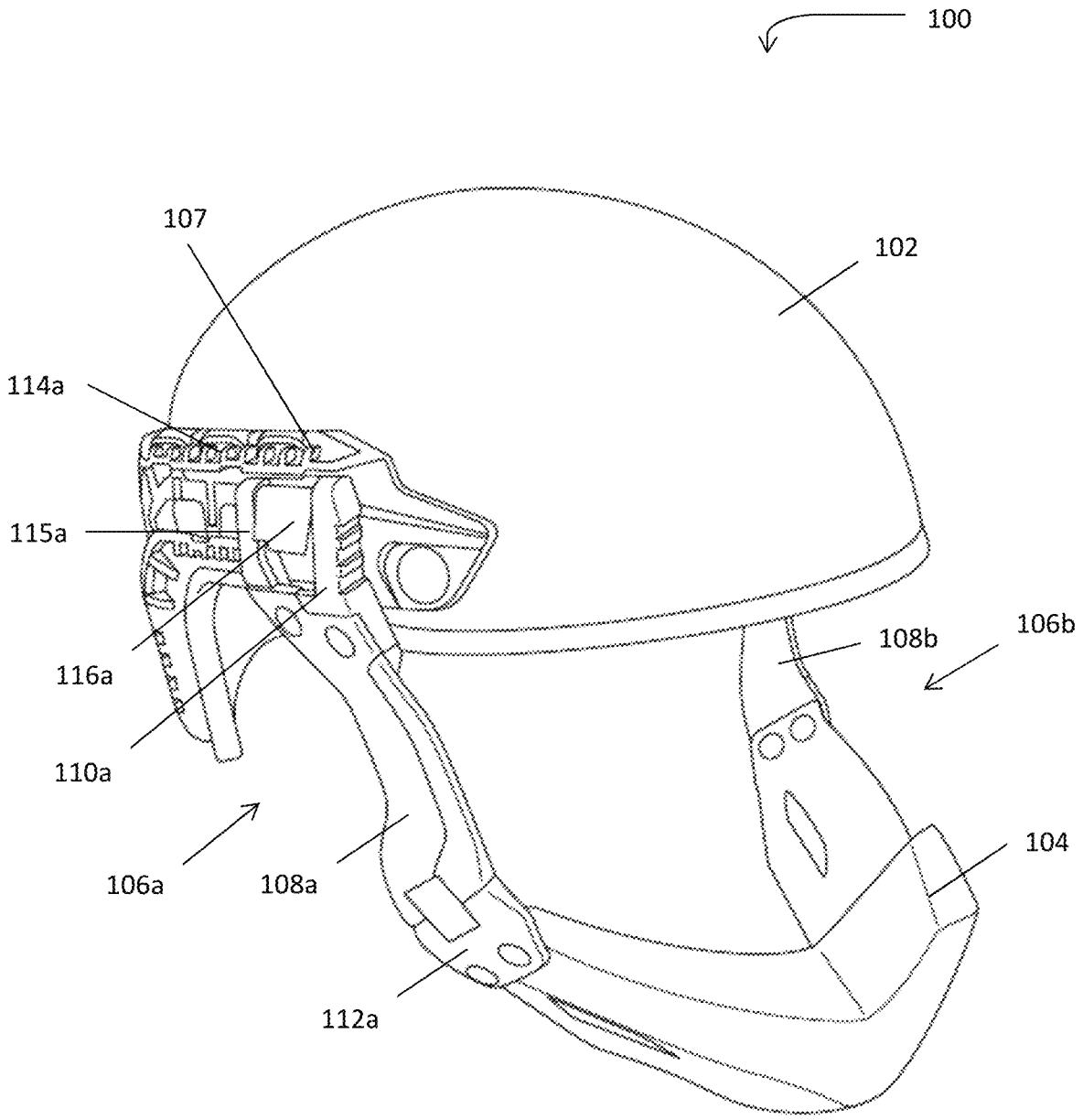
FIG. 1 is a left side perspective view of a helmet, a helmet accessory attachment system, and a mandible guard according to one embodiment.

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Various embodiments are described in connection with a helmet assembly, such as a military combat helmet. However, the invention is not necessarily so limited, and may be employed with other types of helmets, particularly helmets suitable for high impact activities. For ease of understanding, the helmet assembly is described in connection with a military combat helmet, which may be a ballistic or non-ballistic helmet.

Typically, mandible guards are permanently or removably mounted to a helmet to provide a wearer jaw and face protection from projectiles, impacts or other dangers. Although an important piece of protective apparel, when worn, the mandible guard may restrict air flow and/or may restrict normal activities by the wearer, such as, for example, eating and/or drinking. Applicant has recognized that the ability to partially or fully remove the mandible guard to enable access of the lower half of the face and/or to quickly reattach the mandible guard thereafter, may be helpful for comfort and for safety in high-risk environments. For example, such a mandible guard may permit a wearer to take a sip of water by accessing only a portion of the face, and then to quickly reattach the mandible guard.

Applicant has also recognized that such functionality may be achieved with an attachment system that allows the mandible guard to remain secured to one side of the helmet while allowing the other side of the mandible guard to be detached. For example, the wearer may detach the mandible guard from one side of the helmet and then move the mandible guard away from the wearer's face. In some embodiments, the attachment systems disclosed herein may permit a wearer to efficiently attach, secure, unsecure, detach, and/or remove a mandible guard from one side of the helmet using only one hand, while allowing the mandible guard to still be attached to the helmet. As will be appreciated, such attachment systems may permit the wearer to avoid having to put down objects from his or her other hand while detaching the mandible guard. In some embodiments, such attachment systems provide the wearer full access to the mouth area, which enables activities such as eating, drinking, and spitting, without entirely removing the mandible guard.

According to one aspect, a helmet system includes a helmet, a mandible guard, and an accessory attachment member that removably attaches and secures the mandible guard to the helmet. As will be appreciated, the accessory attachment member may be mounted to the helmet either directly or indirectly through other components associated with the helmet (e.g., a helmet mount). According to some embodiments, the mandible guard is arranged to move outwardly and away from the face of the wearer while one side of the mandible guard remains secured to the helmet. For example, the mandible guard may pivot away from a first side of the helmet while the mandible guard remains secured to a second side of the helmet.

In some embodiments, the mandible guard may be attached and secured to the helmet via accessory attachment members that include an attachment arm. In some embodiments, the attachment arm may extend between a connection region on the helmet and a connection region on the mandible guard. For example, the attachment arm may extend between an accessory attachment member mount (e.g., a slidable insert having a finger-actuatable lock) that engages with a helmet mount (e.g., an elongated slot), and a mandible guard mount that is attachable to the mandible. In one such example, the attachment arm may include a rigid piece that extends between the accessory attachment mount and the mandible guard mount.

The mandible guard may be initially attached to the helmet but not yet securely affixed thereto in some embodiments. For example, the attachment accessory member may engage with the helmet mount by sliding a block within an elongated slot such that the mandible guard may be placed in a desired position relative to the helmet. As will be appreciated, in this attached position, it may be possible for the block to be intentionally removed from the elongate slot, or for the block to disengage from the slot due to gravity or inertia when the helmet is positioned or moved in various ways. Once the attachment accessory member is secured to the helmet mount, however, the block is prevented from being removed from the slot, and the mandible guard will remain affixed to the helmet at least until the block is unsecured. In some embodiments, securing and removing the mandible guard from the helmet may be done without the use of a tool.

In some embodiments, when the mandible guard is secured to the helmet via the accessory attachment members, the mandible guard is maintained in a protection position. For purposes herein, a protection position of the mandible guard means that the mandible guard is positioned in front of a portion of a wearer's face, such as in front of the wearer's mouth and/or jaw. As will be appreciated, in such a protection position, the mandible guard need not contact the wearer's face. For example, the mandible guard may be spaced from the wearer's face in the protection position. In other embodiments, the mandible guard may contact the wearer's face in the protection position. For example, an interior portion of the mandible guard may include a padded cushion, which may rest up against a wearer's chin.

In some embodiments, when the mandible guard is secured to the helmet, the mandible guard may be maintained in a fixed position relative to the helmet. For example, when the mandible guard is secured to the helmet via the accessory attachment members and is in the protection position, the attachment arms may not pivot relative to the helmet. As will be appreciated, in such an example, the mandible guard also does not pivot relative to the helmet. The mandible guard may be rigidly connected to the helmet. In such embodiments, the mandible guard may be configured such that it maintains a distance from the wearer's face when forces are applied to the mandible guard. For example, when the mandible guard is secured to the helmet, the mandible guard does not pivot inwardly from the protection position.

In some embodiments, the accessory attachment members are configured such that one of the attachment arms remains secured to the helmet while the other attachment arm is detached from the helmet. In such embodiments, when a first attachment arms is detached from a first side of the helmet, the mandible guard may pivot relative to a second attachment arm attached to a second side of the helmet, and move outwardly and away from the wearer's face. In such embodiments, the mandible guard may pivot with respect to the second attachment arm. For example, in some embodiments, the mandible guard mount may be hingedly connected to the attachment arm, such as via a hinge with a hinge pin defining an axis of rotation, though other hinge arrangements may be used. For purposes herein, pivoting of the mandible guard includes pivoting, rotating, turning, swiveling or otherwise moving in other than a purely translational movement. In some embodiments, the hinge may have more than one pin, such as two pins that define two axes of rotation about which the mandible guard may rotate.

According to some embodiments disclosed herein, an attachment arrangement is provided whereby a wearer can easily attach and secure an accessory attachment member to a helmet mount. The attachment accessory member is initially attached to the helmet mount by engaging a helmet accessory attachment member mount with the helmet mount. For example, the accessory attachment member may include a slidable block that is inserted into an elongate slot of the helmet mount to initially attach the accessory attachment member to the helmet. A finger-actuatable lock may be used to secure the slidable block within the elongate slot. The structure of the lock may be such that unintentional disengagement of the lock is unlikely. The lock may include a pivot arm which allows for straightforward, finger-actuatable unlocking so that the wearer, without the use of a tool, can easily unlock the accessory attachment arm and remove the attachment accessory member from the slot to release the accessory attachment arm from the helmet mount.

In some embodiments, the accessory attachment member mount includes a slidable insert, such as a slidable block that engages with an elongate slot in the helmet mount, such as a rail attached to the helmet. In some embodiments, the elongate slot may be any structure that includes an opening and a receiving area to receive a portion of the accessory attachment member. For example, the elongate slot may include any suitably shaped recess or cutout sized to accept and retain a portion of a periphery of the movable member.

In some embodiments, the lock includes a protrusion with a first blocking surface. When the lock is in a disengaged position, the accessory attachment member mount is movable relative to the helmet mount. When the accessory attachment member mount is engaged with the helmet mount and the lock is in the locked position, the first blocking surface of the protrusion interacts with a second block surface of the helmet mount to prevent movement of the accessory attachment member relative to the helmet mount. In some embodiments, the second blocking surface is a restraint, a barrier, a narrowing channel, or other impediment which prevents motion of the accessory attachment member mount (such as the slidable block) toward the slot opening where the accessory attachment member mount may be released from the helmet mount.

The first blocking surface of the lock may be fixed to a lock actuator, and the blocking surface may be movable to a locked position in which the blocking surface protrudes from an underside of the slidable block in some embodiments. In some embodiments, the locking actuator is a pivot arm that moves the lock between the locked and unlocked positions without the use of a tool. For the sake of clarity, the embodiments herein are described with reference to a pivot arm, though other configurations of a lock actuator are contemplated.

When the pivot arm is initially in the unlocked position, the pivot arm may be biased toward the unlocked position for a first part of the rotation and toward the locked portion for a second part of the rotation. When the pivot arm is initially in the locked position, the pivot arm may be biased toward the locked position for part of the rotation and toward the unlocked position for a second part of the rotation. Such an arrangement may help keep the pivot arm in its existing state until the wearer intentionally moves the arm to the other state. For example, the pivot arm may be biased toward the locked position by a biasing element such as a spring, a cantilever, or other suitable device capable of applying a force to the pivoting member. In some embodiments, the pivoting member may not be biased. In some embodiments, the pivot arm is not biased throughout an entire rotation, but instead encounters a protrusion or other impediment that requires a threshold force on the pivot arm to overcome.

When it is desired to mount the mandible guard (or other accessory) to a helmet, a wearer positions the accessory attachment member mount, such as a slidable insert, in the opening of the elongate slot on the helmet mount. The slidable insert is then moved into the elongate slot away from the opening until a blocking portion engages with the helmet mount to prevent further sliding inwardly. Once the blocking portion abuts the mount, the user may rotate the pivot arm toward the locked position.

When the pivot arm is in the locked position, the first blocking surface of the lock engages with a corresponding groove in the elongate slot, and a blocking surface of the groove constrains the slidable block's movement within the slot. This constraint secures the accessory attachment member to the helmet mount and locks it into position.

To remove the accessory attachment member from the helmet mount, the user pulls the pivot arm toward the unlocked position. Due to a biasing element or other resistance, rotation of the pivot arm is resisted until a threshold force is achieved and/or a certain amount of rotation occurs. When the blocking surface is disengaged from the corresponding groove in the elongate slot, the slidable block may be slid toward the opening of the elongate slot and removed from the elongate slot. In some embodiments, this system permits a user to attach and remove the accessory attachment member from the helmet mount using a single hand.

Turning now to the figures, FIG. 1 shows an example of a helmet assembly 100 according to the present disclosure. As shown in this figure, the assembly 100 includes a helmet 102, a mandible guard 104, and an accessory attachment system, including accessory attachment members 106*a*, 106*b*, that are used to selectively attach and secure the mandible guard 104 to the helmet 102. In such embodiments, the helmet and/or mandible guard may be a military helmet and/or may be ballistic rated. For example, the helmet and/or mandible guard may meet at least ballistic threat level I, at least ballistic threat level IIA, at least ballistic threat level II, at least ballistic threat level IIIA, at least ballistic threat level III, and/or at least ballistic threat level IV, per the Ballistic Resistance of Body Armor NIJ Standard—0101.06 dated July 2008. As will be described, in some embodiments, one of the accessory attachment members 106*a*, 106*b* may be detached from the helmet while the other accessory attachment member 106*a*, 106*b* may remain secured to the helmet.

In some embodiments, each accessory attachment member 106*a*, 106*b* includes an attachment arm 108*a*, 108*b* that extends from an accessory attachment member mount 110*a*, 110*b* to a mandible guard mount 112*a*, 112*b*. In such embodiments, the accessory attachment mount 110*a*, 110*b* engages with a respective helmet mount 114*a*, 114*b* on the helmet, and the mandible guard mount 112*a*, 112*b* is coupled to the mandible guard 104.

In one embodiment, as shown in FIG. 1, the accessory attachment mounts 110*a*, 110*b* may engage with helmet mounts 114*a*, 114*b* located on a portion of the helmet that is placed near a wearer's temple. In this regard, the attachment arm 108*a*, 108*b* may extend downwardly to the mandible guard mount 112*a*, 112*b*. As will be appreciated, the attachment arms may extend perpendicularly from an elongation direction of the helmet mount (and/or helmet) or may extend at an angle other than ninety degrees from the helmet mount, as is shown, toward the mandible guard. As will be further appreciated, the attachment arm also may be located on another portion of the helmet and may extend in another direction (e.g., horizontally), toward the mandible guard.

Figure 2:
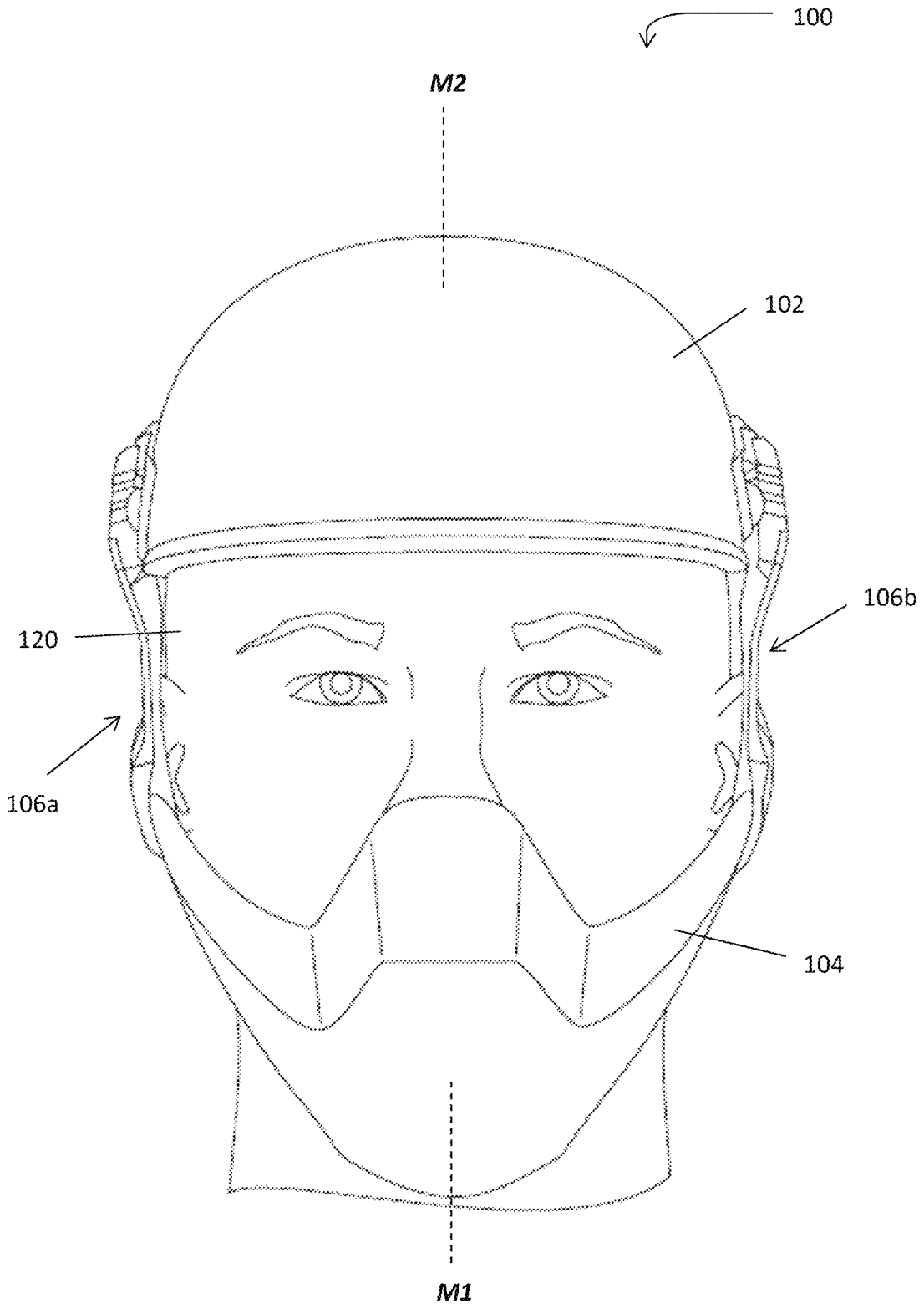
FIG. 2 is a front view of the helmet of FIG. 1 being worn by a wearer.

FIG. 2 shows the helmet system 100 being worn by a wearer 120. In some embodiments, as is shown, when the mandible guard 104 is attached to the helmet 102 via the accessory attachment members 106*a*, 106*b*, the mandible guard 104 is placed in a protection position. For purposes herein, a mandible guard protection position includes positions where a mouth covering portion of the mandible guard is placed in front of the wearer's face, such as the wearer's jaw, mouth and/or nose. In such a position, as shown in FIG. 2, a midline M1 of the mandible guard 104 may be aligned with a midline M2 of the helmet 102. As will be appreciated, in such a position, the mouth covering portion of the mandible guard is also aligned with the midline M2 of the helmet in the protection position. Alignment of the mouth covering portion does not require a symmetrical centering of the mouth covering portion with the midline. Instead, alignment means that a portion of the mouth covering portion is intersected by the midline M2.

In some embodiments, when the mandible guard is in the protection position, the mandible guard is spaced from at least a portion of the face (e.g., the mouth and nose, to allow the wearer to breath). As will be appreciated, the mandible guard may be arranged to be completely spaced from the wearer's face so that the mandible guard does not contact the wearer 120. The mandible guard also may be arranged to contact at least a portion of the wearer. For example, a lower interior portion of the mandible guard (not shown) may have a padded cushion portion to cradle the wearer's chin and/or the bottom of a wearer's jaw.

As will be further appreciated, the mandible guard also may be arranged such that the position of the mandible guard with respect to the wearer's face may be adjusted when the mandible guard is attached to the helmet. For example, a wearer with a smaller face may be able to move the positon of the mandible guard closer to his or her face. In some embodiments, a position adjustment may require a multiple action process, such as a two or three action process. That is, a first action may include unsecuring a component, a second action may include adjusting the position and/or angle of the mandible guard, and a third action may include re-securing the component. In this manner, while in the protection position, the mandible guard may be maintained in a non-pivotal and non-movable configuration. When the wearer desires to adjust the mandible guard, a component may be loosened or otherwise unsecured to allow adjustment. For example, in some embodiments, one or more screws may be loosened to allowing pivoting of the mandible guard relative to the attachment arms. In some embodiments, a tool-less adjustment arrangement may be used, such as the arrangement shown in U.S. Patent Application Publication No. 2015/0135417, which is hereby incorporated by reference. With this approach, the wearer may perform two actions—pressing on a pawl release mechanism and pivoting the mandible guard.

Accordingly, the mandible guard positioning may be adjusted by unsecuring a component and adjusting the mandible guard. However, to pivot the mandible guard away from the protection region, for example, about an axis that ultimately positions the mandible guard more to the left or right side of the helmet, the accessory attachment arm is detached from the helmet mount.

In some embodiments, when the mandible guard is secured to the helmet in the protection position and no adjustment components have been unsecured, the mandible guard does not pivot relative to the helmet when a force is applied to the mandible guard. In such embodiments, the attachment arms also may not pivot relative to the helmet when the mandible guard is secured to the helmet when a force is applied to the outer surface of the mandible guard. For example, the attachment arm 108*a*, 108*b* may include a rigid member made of a suitable material such as steel that does not deform when the mandible guard is in the protection position. In such embodiments, the mandible guard is arranged to not pivot or otherwise move inwardly.

Figure 3:
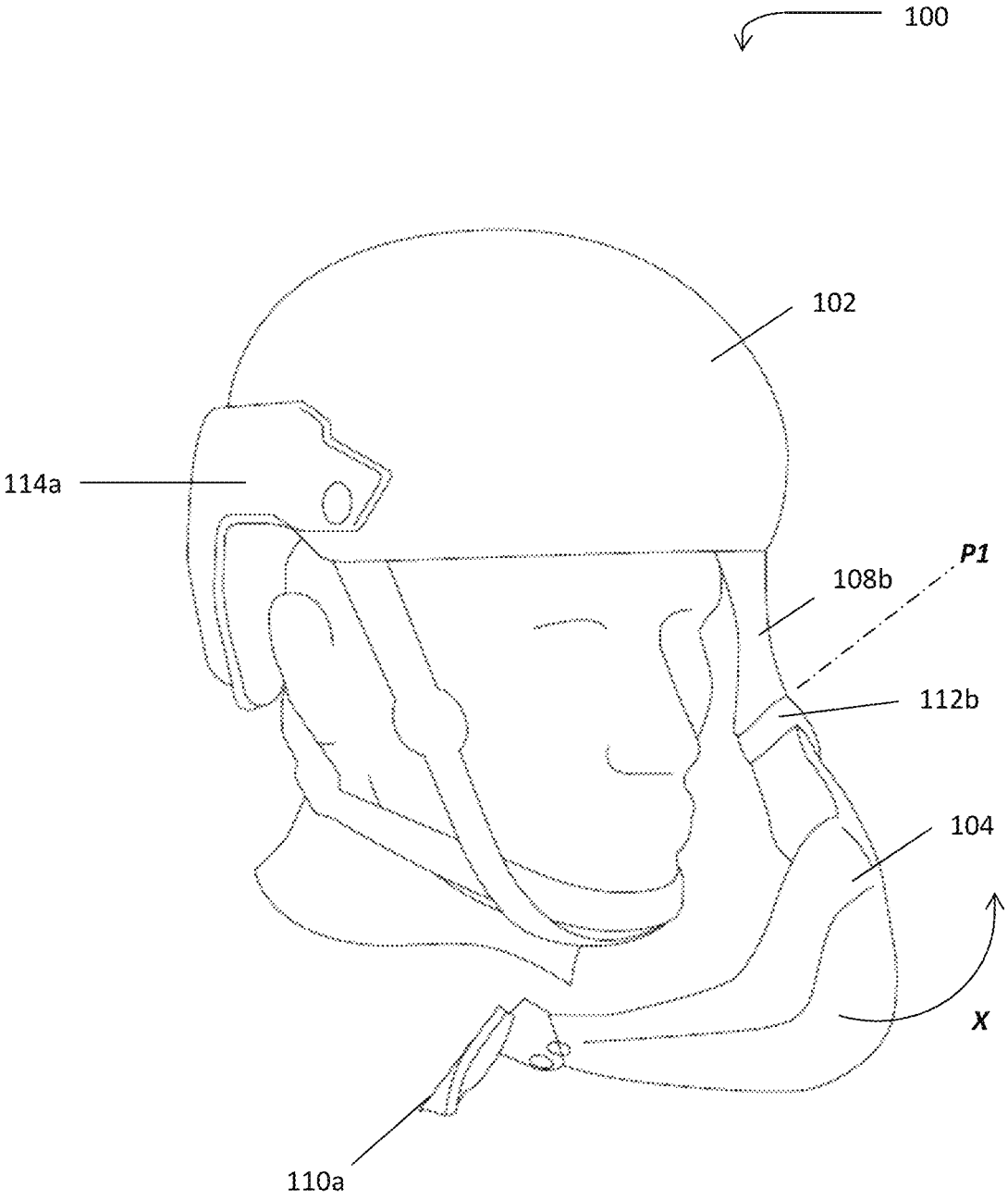
FIG. 3 shows a mandible guard detached from one side of a helmet according to one embodiment.

According to some embodiments herein, the mandible guard is arranged to be moveable out of the protection position to permit access of at least a portion of the wearer's face. As shown in FIG. 3, in some embodiments, the mandible guard is moveable out of the protection position by detaching a first accessory attachment member mount 110*a* from the first helmet mount 114*a* on a first side of the helmet 102, and moving the mandible guard 104 outwardly and away from the wearer (see arrow X). In some embodiments, the mandible guard may pivot with respect to a first pivot axis P1 when moved in the outwardly direction. In such embodiments, such a pivot axis may be defined by a hinged connection between the attachment arm 108*b* and corresponding mandible guard mount 112*b*. For example, a hinge having a single hinge pin may define the connection between the attachment arm 108*b* and the mandible guard mount 112*b*.

Figure 4:
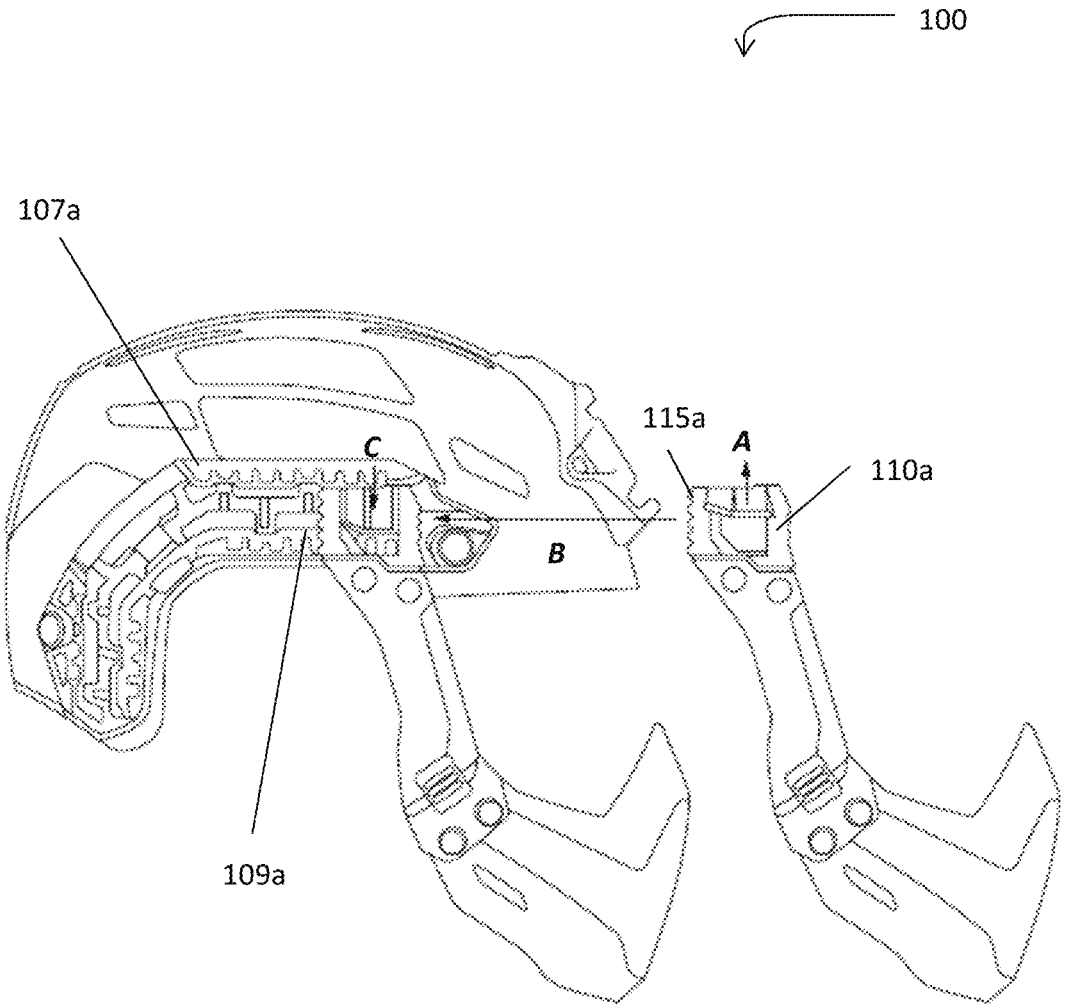
FIG. 4 is a left side perspective view of the helmet of FIGS. 1 and 2, with the accessory attachment system shown attached to and removed from the helmet.
Figure 5:
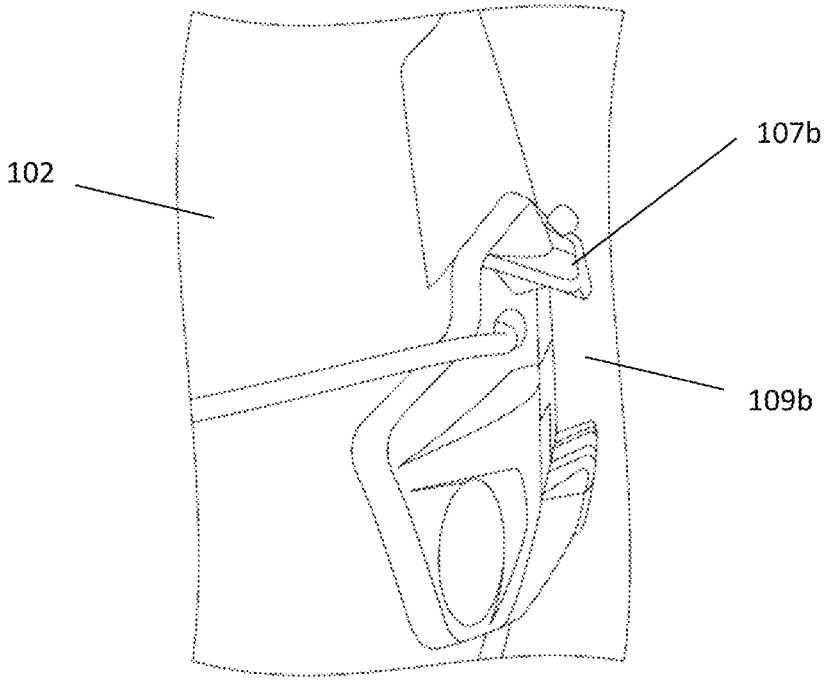
FIG. 5 is an enlarged front view of a helmet mount opposite the helmet mount attached to the helmet of FIG. 4.
Figure 6:
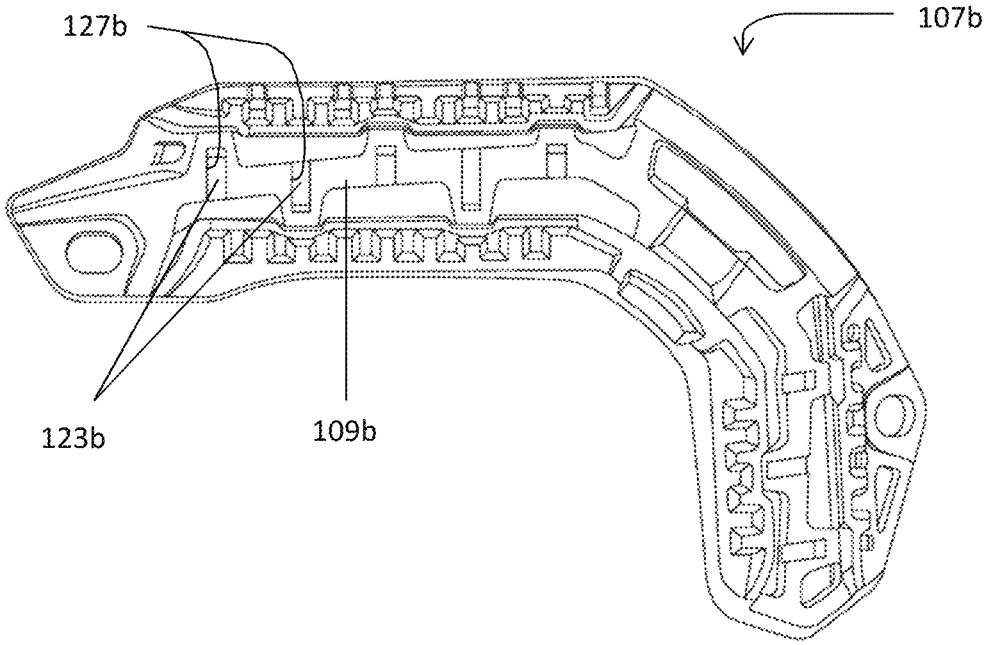
FIG. 6 is a side view of the helmet mount of FIG. 5.

FIG. 4 illustrates a helmet system with the mandible guard in two separate positions—removed from the helmet and secured to the helmet. As in shown FIG. 4, in some embodiments, the helmet system 100 includes accessory attachment rails 107*a*, 107*b* that are attached to each side of the helmet 102. Such attachment rails 107*a*, 107*b* also may include elastic cords, various protrusions and recesses, and/or other components for mounting accessories to the helmet. As shown in FIGS. 4-6, the mandible guard attachment system may include an elongate slot 109*a*, 109*b* within each rail 107*a*, 107*b*. As shown in FIG. 4, to attach the mandible guard to the helmet, the slidable inserts 115*a*, 115*b* of the accessory attachment member mount 110*a*, 110*b* are slid into the elongate slots 109*a*, 109*b*. As will be appreciated, if it is not already in a raised position, the pivot arm 116*a*, 116*b* may be first pivoted in an upward direction (see arrow A in FIG. 4). Once the slidable inserts are inserted into the slots (see the arrow labeled B in FIG. 4), the accessory attachment members 106*a*, 106*b* and the mandible guard 104 are supported by the engagement of the accessory attachment mounts 110*a*, 110*b* with the helmet mounts 114*a*, 114*b*.

Figure 7:
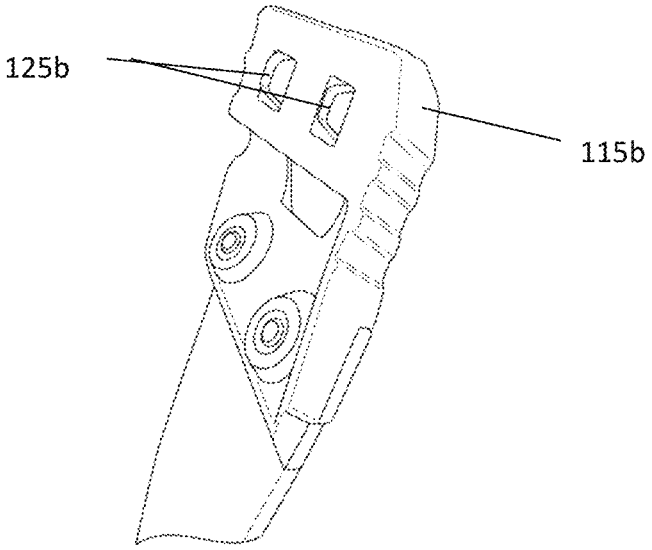
FIG. 7 illustrates a perspective rear view of an accessory attachment member mount.

The accessory attachment members 106*a*, 106*b* may then be fully secured to the helmet mounts by pivoting the pivot arms 116*a*, 116*b* downwardly until their respective lock protrusions are inserted into corresponding grooves in the rails 107 (see the arrow labeled C in FIG. 4). Grooves 123*b* in one rail 107*b* are shown in FIG. 6. By inserting the lock protrusions 125*b* into the grooves 117*b* (see FIGS. 6 and 7), each slidable insert 115*b* is prevented from sliding in a direction toward the openings of the elongate slots 109, thereby fully securing the accessory attachment member to the helmet mount. When in the locked position, the pivot arms may be substantially flush with an outer surface of the accessory attachment member so that the pivot arms do not present a snag hazard. An open or recessed area may be provided immediately under the pivot arm so that a wearer can fit his or her finger below the pivot arm when unlocking the pivot arm. The pivot arm is illustrated as a substantially flat plate in some embodiments, but the pivot arm may include other arrangements such as a curved surface, a rod, or any other suitable arrangement.

In the illustrated embodiment, two grooves 123*b* are arranged on each rail 117*b* to correspond to two lock protrusions on the corresponding accessory attachment member. Each groove 117 includes a respective blocking surface 127*b* that prevents movement of the corresponding lock protrusion toward the opening of the elongate slot 109. In some embodiments, a single groove and a single lock protrusion may be used. In other embodiments, three or more grooves and corresponding lock protrusions may be used. The one or more blocking surfaces of the helmet mount do not necessarily need to be formed within a groove, but may instead be positioned on a protrusion. Other embodiments of the accessory attachment system are described in U.S. patent application Ser. No. 15/284,454, filed Oct. 3, 2016 and entitled "Helmet Accessory Attachment System," which is hereby incorporated by reference in its entirety.

As will be appreciated from the above, to remove one or both sides of the mandible guard, the previously-described steps may be performed in reverse. For example, the pivot arm 115*a*, 115*b* may be pivoted upwardly (in a direction opposed to the arrow labeled C) to remove the lock protrusions from the grooves in the rails. Next, the sliding insert 115*a*, 115*b* may be removed from the elongate slot 109 of the rails 107 (in a direction opposite the arrow labeled B).

As will be appreciated, although FIGS. 1 and 4-6 show the accessory attachment member mounts and helmet mounts as including sliding inserts and elongate slots on rail mounts, respectively, the corresponding mounts may have other suitable arrangements. For example, the accessory attachment member mounts and helmet mounts may have a snap fit or press fit engagement, in which the accessory attachment member mounts may be snapped or press fit onto and disengaged from the helmet mounts. The accessory attachment member mounts and helmet mounts also may include a threaded engagement. In such embodiments, the accessory attachment member mount may be threaded onto and off of the helmet mount. Outer suitable mounting arrangements also may be used in other embodiments.

Figure 8:
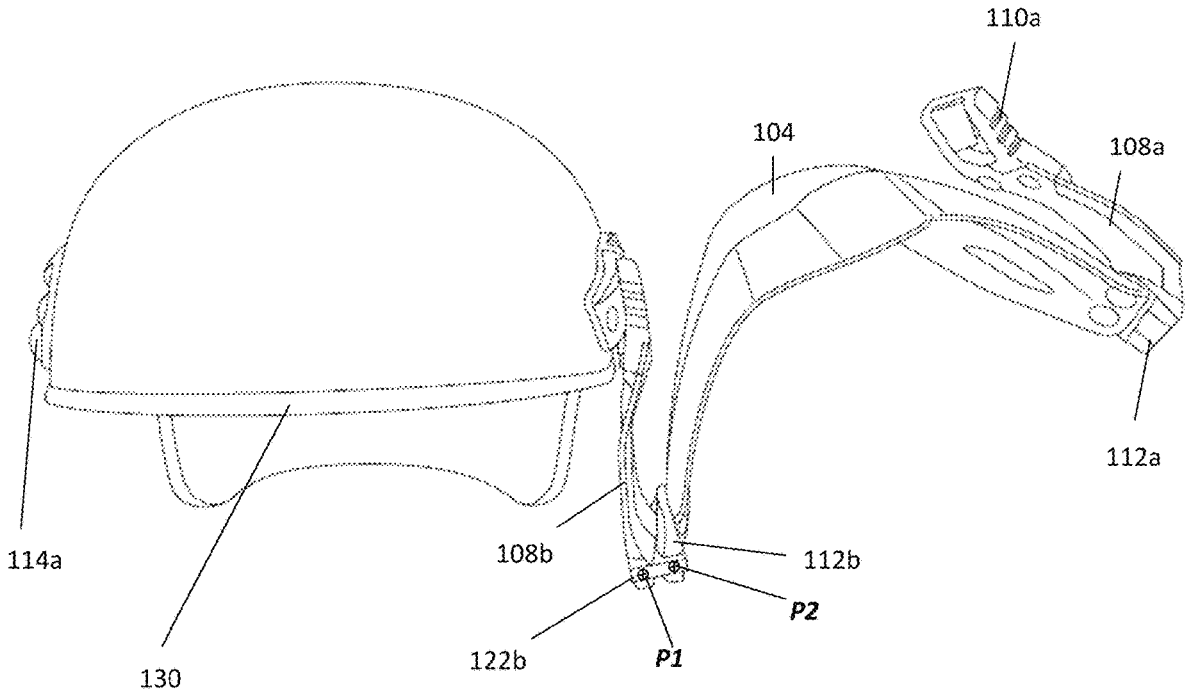
FIG. 8 shows a mandible guard detached from one side of a helmet according to another embodiment.

FIG. 8 shows another embodiment in which the mandible guard has been moved out of the protection position. As illustrated in this figure, the mandible guard mount 112*b* is pivotally connected to the attachment arm 108*b*, with the first accessory attachment member mount 110*a* being detached from the first helmet mount 114*a*. In this embodiment, a hinge connector 122*b* connects the attachment arm 108*b* and the mandible guard mount 112*b* and allows the mandible guard to pivot with respect to two axes P1, P2 of rotation (see also FIG. 10). In some embodiments, the first and second axes of rotation P1, P2 are substantially parallel to one another. In some embodiments, the first and second axes of rotation P1, P2 are each substantially perpendicular to the attachment arms 108*a*, 108. The axes of rotation also may have other suitable orientations. For example, the pivot axes P1, P2 may be oriented at an angle relative to a horizontal reference frame, the horizontal reference frame being defined when the helmet is oriented in an upright position as if being worn by a wearer facing straight ahead. For example, the pivot axes P1, P2 may be oriented between about 30 degrees and 60 degrees, or between about 40 degrees and 50 degrees, or at about 45 degrees, relative the reference horizontal plane in some embodiments. In some embodiments, the pivot axes P1, P2 may be oriented between about 30 degrees and 60 degrees, or between about 40 degrees and 50 degrees, or at about 45 degrees, relative to a substantially horizontal plane that is co-planar with an underside of a front rim 130 at a front-most point of the front rim 130.

Figure 9:
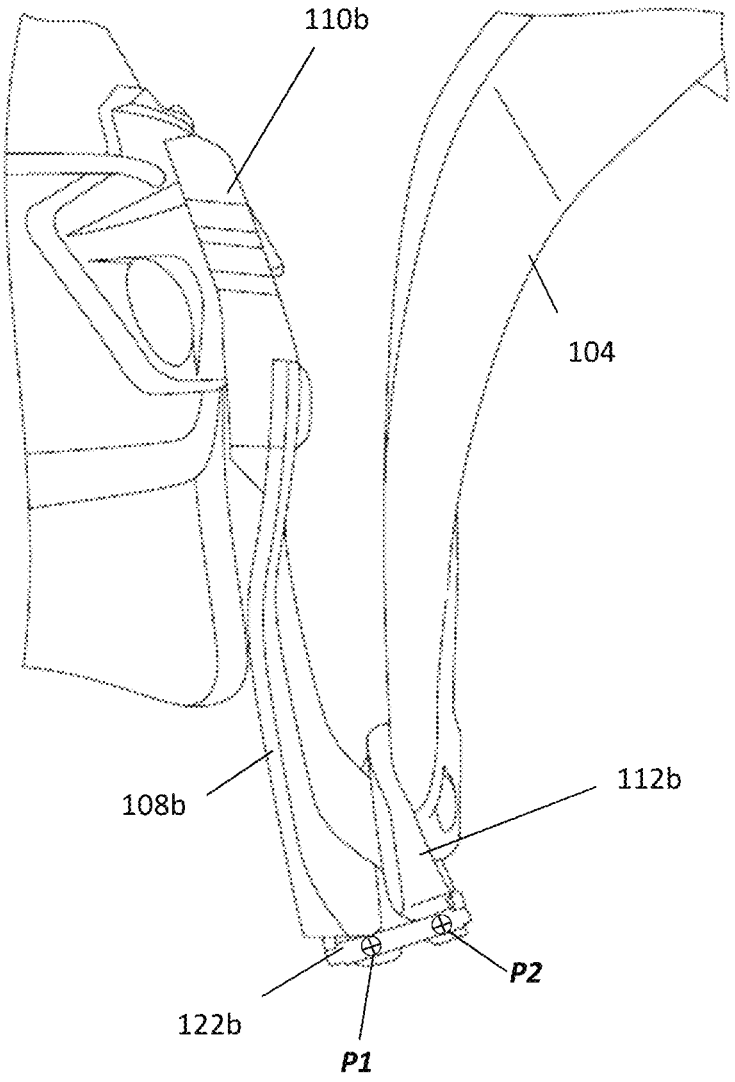
FIG. 9 is an enlarged front view of the accessory attachment system of FIG. 8.
Figure 10:
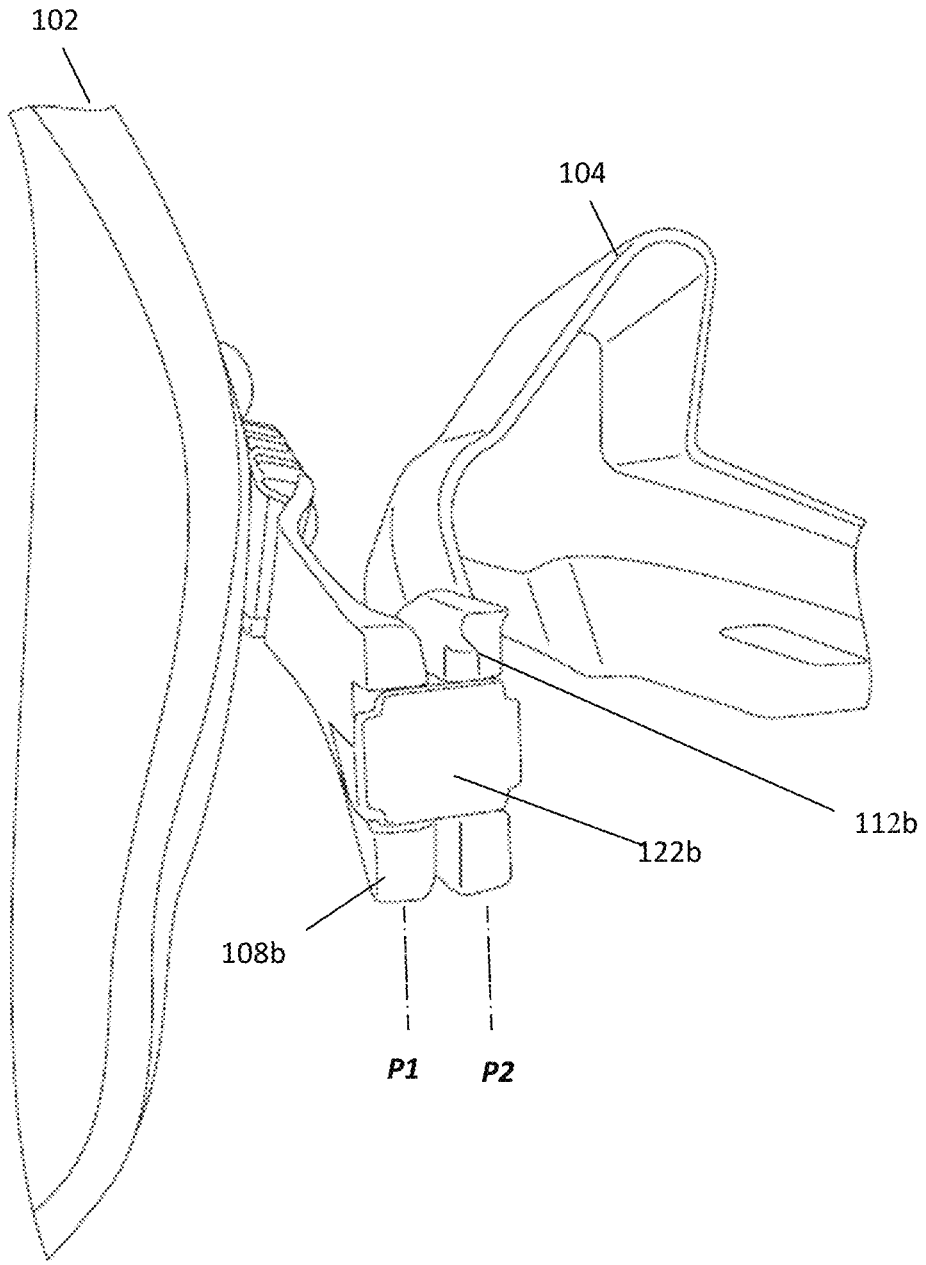
FIG. 10 is a bottom view of the accessory attachment system of FIG. 9.

As shown in FIG. 8, in some embodiments, pivoting around two axes of rotation may allow the mandible guard to be moved not only out of the protection position, but also to a position adjacent an outside surface of the attachment arm. As will be appreciated, such an outward position also may allow substantial access to the wearer's face and jaw. Additionally, when the mandible guard is fully removed from the helmet, pivoting both attachment arms such their outside surfaces are adjacent the mandible guard may provide a convenient storage position. An enlarged front view of the outward position is shown in FIG. 9, with the mandible guard 104 being rotated about the first and second pivot axes P1, P2 and positioned adjacent to the attachment arm 108*b* and the accessory attachment member mount 110*b*. FIG. 10 shows a bottom view of the hinge 122*b* of FIG. 9, with the first and second pivot axes P1, P2 extending downwardly therefrom. When the mandible guard is in the outward position, the hinge connector 122*b* is substantially perpendicular to the attachment arm 108*b* and the mandible guard mount 114*b*. When removed from the helmet, the overall mandible guard assembly size can be reduced by folding the attachment arms in this manner.

Figure 11:
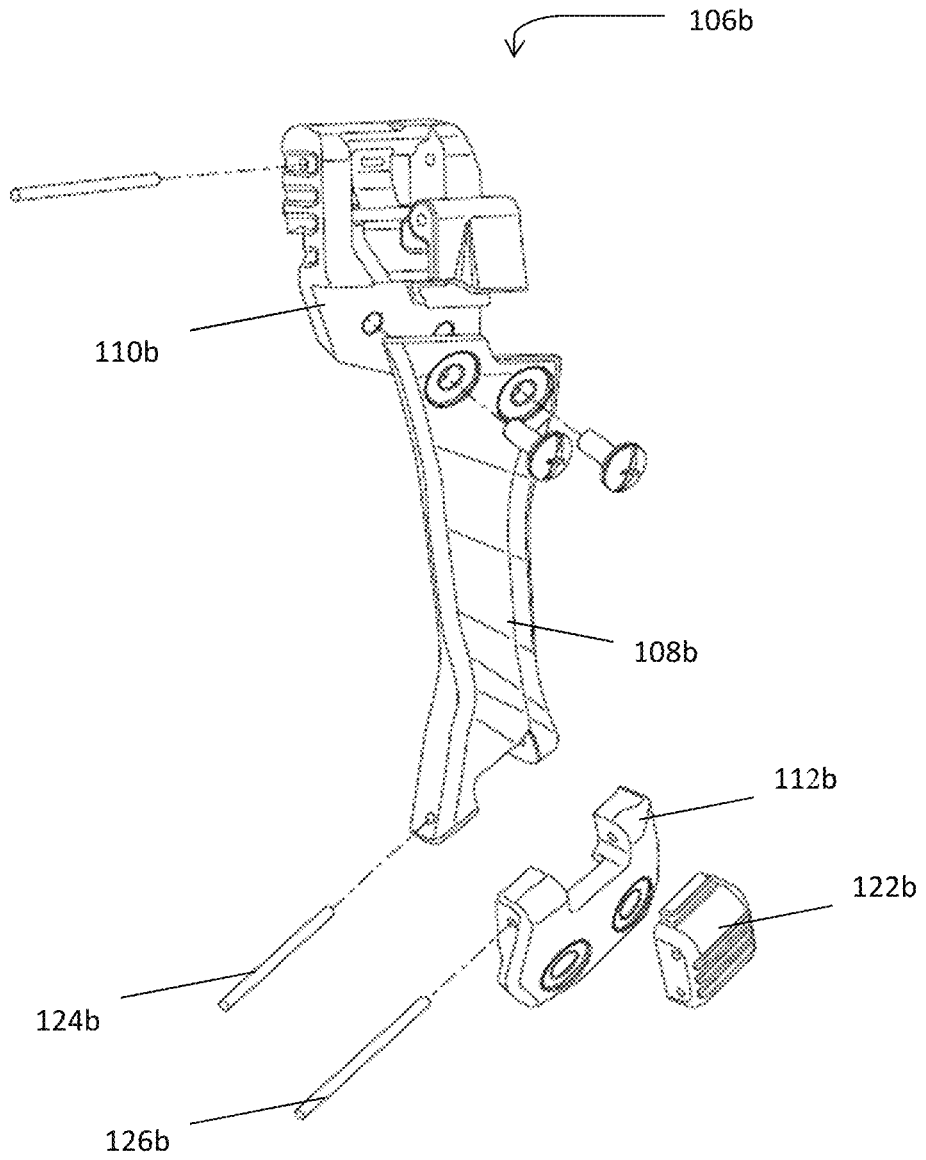
FIG. 11 is an exploded view of an accessory attachment member of FIGS. 8-10.

FIG. 11 shows an exploded view of accessory attachment member 106*b* of FIGS. 8-10. Two pins 124*b*, 126*b* connect the hinge connector 122*b* to the attachment arm 108*b* and mandible guard mount 114*b*, respectively, and define the first and second pivot axes P1, P2, about which the mandible guard (not shown) pivots. FIG. 11 also illustrates the fixed connection (e.g., screws) between the attachment arm 108*b* and the accessory attachment member mount 110*b*. As will be appreciated, in some embodiments, once the accessory attachment member mount 110*b* is secured to the helmet mount (not shown), the attachment arm may not pivot with respect to the helmet.

According to another aspect, a method of wearing a helmet assembly is disclosed. In some embodiments, the method includes placing a helmet on a wearer's head and attaching a mandible guard to the helmet for protecting the wearer's face, such as the wearer's mouth, nose and/or jaw. In some embodiments, attaching the mandible guard includes attaching and securing an accessory attachment member mount, such as a sliding insert, to a helmet mount, such as an elongate slot in a rail on the helmet. In some embodiments, when the mandible guard is secured to the helmet, the mandible guard is placed in a protection position over the wearer's face. In some embodiments, when the mandible guard is secured to the helmet, the mandible guard does not pivot relative to the helmet. In some embodiments, the helmet assembly includes an attachment arm extending between the accessory attachment member mount and a mandible guard mount affixed to the mandible guard. In such embodiments, the attachment arm may be pivotally connected to the mandible guard mount. When the mandible guard is secured to the helmet, the accessory arm also may not pivot with respect to the helmet.

In some embodiments, a method of accessing at least a portion of the wearer's face while the helmet is worn is disclosed. The method may include detaching a first accessory attachment member mount from a first helmet mount on a first side of the helmet. The method further includes moving the mandible guard outwardly and away from the wearer. In such an embodiment, the mandible guard may pivot with respect to the second attachment arm. In some embodiments, the mandible guard mount is hingedly connected to the attachment arm via a hinge. In some embodiments, the hinge has one pin defining a first axis of rotation about which the mandible guard pivots. In some embodiments, the hinge has two pins defining first and second axes of rotation about which the mandible guard rotates. When the mandible guard is in the outward position it may be placed adjacent to the attachment arm.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A helmet assembly comprising:

a helmet;

a mandible guard having a mouth covering portion;

a first attachment arm arranged to removably secure a first side of the mandible guard to the helmet, the first attachment arm being removably attachable to the helmet, the first attachment arm extending from a first helmet connection region to a first mandible guard connection region; and a second attachment arm arranged to removably secure a second side of the mandible guard to the helmet, the second attachment arm being removably attachable to the helmet, the second attachment arm extending from a second helmet connection region to a second mandible guard connection region;

wherein, when the mandible guard is secured to the helmet with the first and second attachment arms:

the mouth covering portion maintains a protection position in which the mouth covering portion is aligned with a midline of the helmet; and movement of the mandible guard in a direction from a front of the helmet to a back of the helmet is prevented by the first and second attachment arms;

wherein, when the second attachment arm is detached from the helmet and the first attachment arm remains secured to the helmet, the mandible guard is movable out of the protection position;

wherein the mandible guard is connected to the first attachment arm via a hinge connector having a first axis of rotation about which the mandible guard rotates relative to the first attachment arm; and wherein the hinge connector includes a second axis of rotation about which the mandible guard rotates relative to the first attachment arm.

2. The helmet assembly of claim 1, wherein the mandible guard is hingedly connected to the second attachment arm.

3. The helmet assembly of claim 1, wherein the mandible guard is rotatable about the first and second axes of rotation to a position where an outer surface of the mandible guard is positioned adjacent the first attachment arm.

4. The helmet assembly of claim 1, wherein the first and second axes of rotation are substantially perpendicular to the first and second attachment arms.

5. The helmet assembly of claim 1, wherein the first and second axes of rotation are oriented at an angle relative to a plane that is co-planar with an underside of a front-most portion of a front rim of the helmet.

6. The helmet assembly of claim 1, wherein the first and second axes of rotation are oriented at an angle of between 30 degrees and 60 degrees relative to a plane passing through an underside of a front rim of the helmet.

7. The helmet assembly of claim 1, wherein the mandible guard includes first and second mandible guard mounts, each of the first and second mandible guard mounts being fixedly attached to the mandible guard.

8. The helmet assembly of claim 1, wherein the first and second helmet connection regions include first and second accessory attachment member mounts.

9. The helmet assembly of claim 8, wherein the first and second accessory attachment member mounts are secured to first and second helmet mounts, respectively.

10. The helmet assembly of claim 9, wherein the first helmet mount includes a first rail having a first elongate slot, and the second helmet mount includes a second rail having a second elongate slot.

11. The helmet assembly of claim 10, wherein the first accessory attachment member mount includes a first slidable insert that is insertable into the first elongate slot.

12. The helmet assembly of claim 11, wherein the second accessory attachment member mount includes a second slidable insert that is insertable into the second elongate slot.

13. The helmet assembly of claim 1, wherein, when the second attachment arm is detached from the helmet and the first attachment arm remains secured to the helmet, the mandible guard is pivotable out of the protection position by pivoting the mandible guard relative to the first attachment arm.

14. A mandible guard as in claim 1, wherein, when the mandible guard is in the protection position, the first and second arms do not pivot relative to the helmet when a force is applied to an outer surface of the mandible guard.

15. A mandible guard as in claim 1, wherein each of the first and second attachment arms includes a rigid member.

16. A mandible guard as in claim 15, where the rigid member of each of the first and second attachment arms does not deform when the mandible guard is in the protection position.

* * * * *